United States Patent [19]

Short et al.

[11] Patent Number: 4,979,878

[45] Date of Patent: Dec. 25, 1990

[54] RELIEVED PISTON VALVE FOR FLUID MOTOR AND FLUID PUMP

[75] Inventors: James L. Short, 5491 S. Beehive Ave., Tucson, Ariz. 85746; Robert L. Short, Tucson, Ariz.

[73] Assignee: James L. Short, Tucson, Ariz.

[21] Appl. No.: 319,424

[22] Filed: Mar. 3, 1989

[51] Int. Cl.[5] ..... F04B 3/00; F04B 21/04

[52] U.S. Cl. ..... 417/255; 417/257; 417/415; 417/489

[58] Field of Search ..... 417/437, 489, 245, 255, 417/257, 262, 415; 91/341

[56] References Cited

U.S. PATENT DOCUMENTS

| | | | |
|---|---|---|---|
| 1,747,537 | 2/1930 | Babin | 417/489 |
| 2,023,466 | 12/1935 | Crowley | 417/489 |
| 2,284,645 | 6/1942 | Duffy | 417/419 |
| 2,394,904 | 2/1946 | Fowler | 417/255 X |
| 2,710,137 | 6/1955 | Arnouil | 92/78 |
| 3,012,699 | 12/1961 | Denman | 417/489 |
| 3,078,033 | 2/1963 | Ovrutsky | 417/489 |
| 3,082,935 | 3/1963 | Arak | 417/489 |
| 3,181,779 | 5/1965 | Rhodes | 417/566 |
| 3,523,001 | 8/1970 | Sylvester et al. | 417/489 |
| 3,703,848 | 11/1972 | Brown, 4th | 91/265 |
| 3,716,310 | 2/1973 | Guenther | 417/552 |
| 4,028,015 | 6/1977 | Hetzel | 417/415 |
| 4,283,995 | 8/1981 | Akkerman | 91/410 |
| 4,627,798 | 12/1986 | Thomas | 417/415 |

FOREIGN PATENT DOCUMENTS

| | | |
|---|---|---|
| 3049290 | 12/1981 | Fed. Rep. of Germany . |
| 301358 | 9/1965 | Netherlands . |

*Primary Examiner*—Leonard E. Smith
*Assistant Examiner*—Eugene L. Szczecina, Jr.
*Attorney, Agent, or Firm*—Cahill, Sutton & Thomas

[57] ABSTRACT

An asymmetrical or relieved piston is provided in a fluid motor or a pump. The piston is rigidly connected to one end of the connecting rod, the opposite end of which is pivotally connected to a rotating crankshaft. The piston has a relieved upper and lower section each of which has a partial spherical surface. When the piston is tilted in one direction through half of a rotation of the crankshaft, a seal is formed between the partial spherical surface and the wall of a cylinder. During the other half of the rotation, the relieved piston is tilted in the opposite direction, the seal is broken, and fluid bypasses the piston from the upper half of the cylinder volume to the lower half or vice versa. A floating poppet valve is utilized in the engine, and a floating check valve is utilized in the pump of the described single piston embodiments. A pump with no check valve but including two horizontally opposed relieved pistons is disclosed in which one piston is sealed while the other is bypassed, providing nearly continuous pumping of fluid during each rotation of the crankshaft.

12 Claims, 2 Drawing Sheets

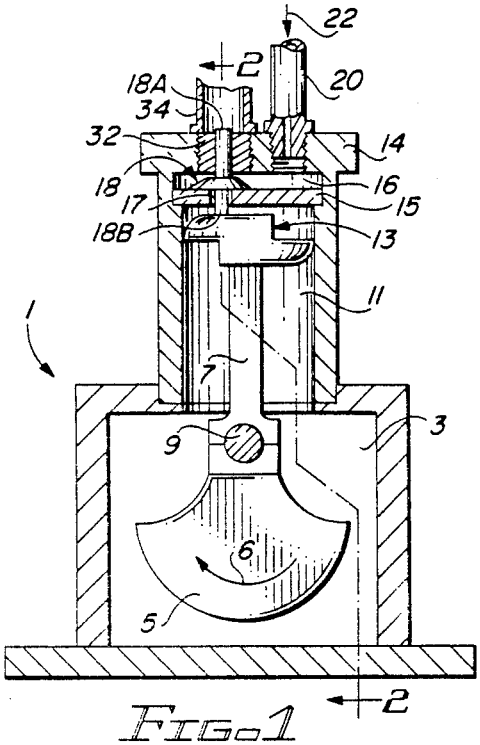
FIG. 1
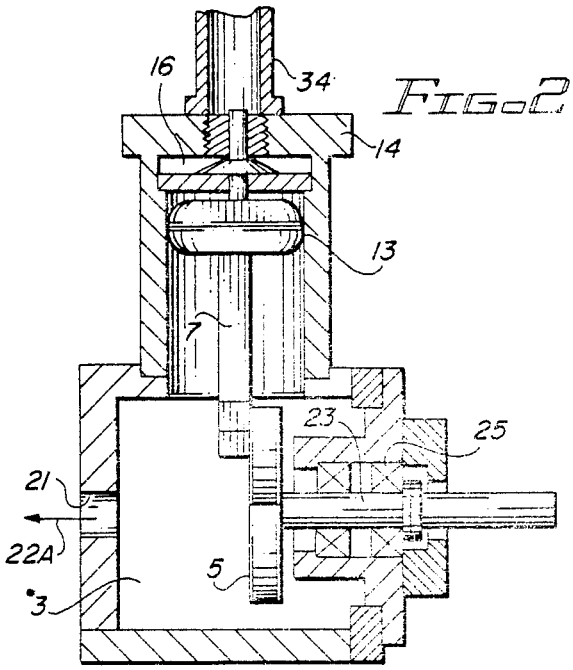
FIG. 2
FIG. 3
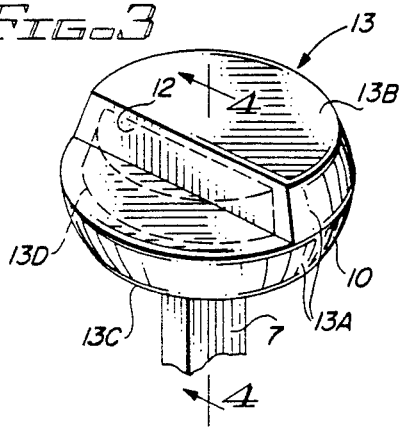
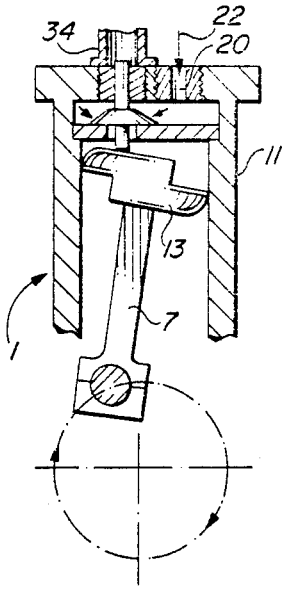
FIG. 6
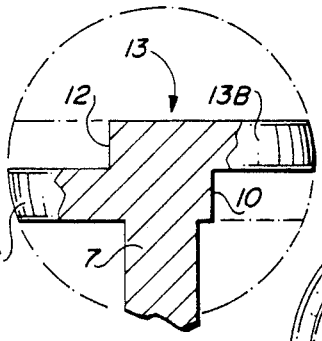
FIG. 4
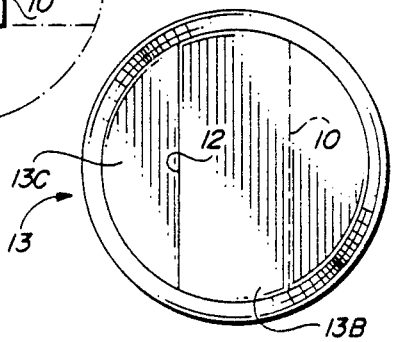
FIG. 5
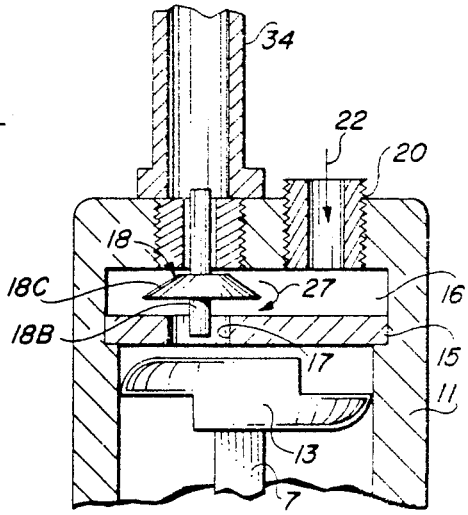
FIG. 7A

RELIEVED PISTON VALVE FOR FLUID MOTOR AND FLUID PUMP

The invention relates to fluid motors and fluid pumps which include tilting pistons.

There are various applications in which an efficient, reliable fluid motor or fluid pump would be desirable. For example, it is believed there are applications for a small pump which weighs only a few grams and is capable of pumping roughly two cubic centimeters of water per second. A variety of compressors with relieved, partial spherical surfaced pistons are known. West German patent DE3049-290 discloses a multi-disc tilting piston structure. Each of the discs has a partial spherical surface. Netherlands patent 301358 discloses a pump with tilt pistons. U.S. Pat. No. 3,716,310 discloses a compressor with a spherical ball piston. Other patents, including U.S. Pat. 3,181,779 and 4,028,015 disclose compressors with tiltable pistons. A number of fluid pressure engines are known, including one disclosed in U.S. Pat. No. 3,703,848, disclose check valves or poppet valves which are actuated by the top of a piston as it moves to its top dead center position. Motors of this type do not produce much power because of two significant drawbacks. Since the cylinder is vented by ports at the bottom of the stroke, gas must be recompressed for the piston to reach top dead center. High speed performance is limited. The poppet valve is held open by the piston for only a short time. Several prior art references, including U.S. Pat. 3,078,033, permit fluid to bypass a piston when it is tilted. U.S. Pat. 3,078,033 discloses a structure with a tilting piston which has leather seals. The center of the crank-shaft is offset relative to the longitudinal axis of the cylinder in which the piston moves. The amount of tilt is limited by the space allowed for the rod to rotate between the centerline of the cylinder and the cylinder wall. When the piston tilts in the rectangular cylinder it is not constrained on two sides. Therefore pump is limited to operation at very low speeds pumping a gas such as air. U.S. Pat. 3,523,001 discloses a similar structure. This pump uses a flexible packing to seal the piston to a circular cylinder. Piston tilt is also limited by the use of an offset crankshaft. U.S. Pat. 2,023,466 discloses a structure with a partial spherical piston attached to the rod at an oblique angle. Large tilt angles cannot be achieved because the piston interferes with the crankshaft when mounted at this angle. Also this piston structure is difficult to produce in a small size.

None of the known prior art references show a fluid pump which can be made very small in size. None of the prior art references disclose a fluid engine of so simple construction that it can be made both extremely small or large and yet provide a high level of performance.

There remains an unmet need for a fluid motor of simple construction which can operate efficiently at high speeds, and a miniature pump which can pump viscus fluids such as water or oil, and that these devices be more reliable, efficient, and economical than any of those known in the prior art.

SUMMARY OF THE INVENTION

Accordingly, it is an object of the invention to provide a tilting-piston fluid pump that has better efficiency pumping higher viscosity fluids than those of the prior art.

It is another object of the invention to provide an efficient tilting-piston fluid motor.

Briefly described, and in accordance with one embodiment thereof, the invention provides a fluid engine or a pump including a tiltable relieved piston rigidly connected by a connecting rod to a bearing on a rotating crankshaft. The relieved piston has a partial spherical surface that forms a seal with the inner wall of a cylinder in which the relieved piston moves, so that during a downstroke of the relieved piston in the engine, or an upstroke of the piston in the pump, the partial spherical surface forms a seal with the inner wall of the cylinder, and during an upstroke of the engine or the downstroke of the pump the piston is tilted in the opposite direction and the seal is broken, providing a passage between the cylinder wall and the spherical surface of the piston so that fluid in the cylinder bypasses the piston.

In the described engine, a floating poppet valve is supported in a compressed gas chamber above the cylinder by a valve guide, aligning the upper valve stem in the cylinder head, and includes a lower stem extending through a valve plate into the cylinder. The top surface of the upper stem of the valve is exposed to a regulated low pressure environment supplied to the valve guide. The top of the piston contacts the stem prior to its top dead center position, breaking the seal of the poppet valve, allowing pressurized gas in the chamber above to flow through a port in the valve plate into the top of the cylinder, forcing the piston downward, causing rotation of the crankshaft. The gas in the upper chamber and cylinder reach equilibrium quickly before the piston leaves the top dead center position. This pressure acts on the bottom of the poppet valve on an area equal to the area of the valve guide. Since the opposing area on top of the valve is at a lower pressure, the valve is forced open. Pressure acting on the piston causes it to accelerate downward. This sudden increase in volume causes a pressure drop and causes flow to increase through the valve port. The resulting drag force on the valve skirt overcomes the force acting from the pressure difference and the valve closes. Pressurized gas in the high pressure chamber maintains the poppet valve closed until the top of the piston again engages the stem of the poppet valve just before the end of the upstroke to begin another cycle.

In the described embodiment of the pump, a floating check valve is provided in the top of the cylinder to allow fluid which is drawn into the crankcase and which bypasses the tilted relieved piston during a downstroke is then ejected through the check valve and an outlet in a cylinder head during an upstroke of the oppositely tilted relieved piston.

Another pump is disclosed including two tilting relieved pistons in horizontally opposed cylinders, wherein during one half cycle one piston is sealed to its cylinder wall and acts as a pump and as a check valve, and the other is oppositely tilted to function as an open valve. During the other half cycle the functions of the two pistons are reversed, providing nearly continuous pumping of fluid throughout a full rotation of the crankshaft.

BRIEF DESCRIPTION OF THE DRAWINGS

FIG. 1 is a section view of a fluid motor of the present invention.

FIG. 2 is a section view taken along section line 2—2 of FIG. 1.

FIG. 3 is a partial perspective view of a piston of the fluid motor of FIG. 1.

FIG. 4 is a partial cut-away section view taken along section line 4—4 of FIG. 3.

FIG. 5 is a top plan view of the piston shown in FIG. 3.

FIG. 6 is a partial section view useful in describing the operation of the fluid motor of FIG. 1.

FIGS. 7A–7C are partial section view diagrams useful in explaining the operation of the fluid motor of FIG. 1.

DETAILED DESCRIPTION OF THE PREFERRED EMBODIMENTS

Figure 7B:
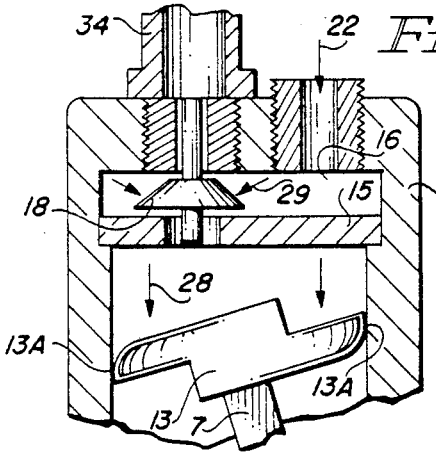

Referring now to the drawings, particularly FIGS. 1–5, fluid motor 1 includes a crankcase 3 in which a crankshaft 5 rotates clockwise in the direction indicated by arrow 6. A connecting rod 7 is pivotally connected to crankshaft 5 by a bearing 9. Connecting rod 7 also is rigidly connected to a "relieved" or "asymmetrical" piston 13, in accordance with the present invention. Relieved piston 13 moves vertically in cylinder 11. The interior of cylinder 11 opens into the interior of crankcase 3. An outlet vent 21 allows "spent" exhaust fluid to escape as indicated by arrow 22A. A tube 34 is connected to valve guide 32 to provide regulated pressure and a system return for leaked gas. Crankshaft 5 includes a shaft 23 that is supported by a bearing assembly 25 and extends out of the right end of crankcase 3, as shown in FIG. 2.

The top of cylinder 11 is covered by a cylinder head 14. A "floating" poppet valve 18 includes an upper stem 18A extending through a valve guide 32 disposed in a cylinder head 14. Poppet valve 18 has a disc-shaped body or flange 18C, which preferably has a tapered upper surface. Poppet valve 18 is vertically moveable in a high pressure inlet chamber 16 located between the bottom of cylinder head 14 and the top of a valve plate 15. A lower stem 18B of poppet valve 18 extends through a larger hole 17 in valve plate 15. An inlet 20 receives pressurized gas 22 that powers fluid motor 1, as subsequently explained.

As best seen in FIGS. 3 and 4, relieved piston 13 has a partial spherical outer surface 13A. An upper portion 13B has a flat upper surface and has the shape of two-thirds of a "slice" of a sphere. A lower portion 13C of piston 13 also has the shape of two-thirds of a slice of a sphere. The thicker part of "slice" 13B overlaps and is integral with the thicker part of "slice" 13C, resulting in two "notches" 12 and 13.

If desired, the notch 12 can be filled with a "filler" designated by dotted lines 13D. Filler 13D can be advantageous in the embodiment of the invention which operates with compressible gasses as either a pump or motor. The filler reduces the volume between the piston and top of the cylinder causing the pump to expel more gas, and in the motor, allowing more expansion of the gas against the piston, thereby improving the efficiency of such a pump or motor.

As shown in FIGS. 1 and 2, with relieved piston 13 at top dead center, poppet valve 18 is held open. In this position, the clearance between the bottom of the valve flange 18C is approximately 0.010 inches above the top of seal plate 15, in a prototype that has been constructed.

FIG. 6 shows piston 13 approaching the top of cylinder 11. At this point the partial spherical surface 13A of relieved piston 1 has just become sealed to the wall cylinder 11. High pressure gas 22 is contained in chamber 16 above valve plate 15. FIG. 6 illustrates the position of piston 13 (as the crankshaft rotates clockwise) at the instant the top of piston 13 strikes the poppet valve stem 18B. After apprOximately 12 degrees of further rotation, with relieved piston 13 at top dead center, floating poppet valve 18 has been raised to the level shown in FIGS. 1 and 2.

As shown in FIG. 7A, piston 13 is at top dead center. High pressure gas 22 is supplied to chamber 16 through inlet 20. Pressures above and below the valve plate 15 have reached equilibrium through port 17. The poppet valve 18 is held open by the difference in pressure between the cylinder and tube 34.

It should be noted that this "floating" poppet valve structure is an improvement over mechanically operated poppet valves which must be held open by a piston physically pushing on the valve stem. In order for such prior poppet valves to have sufficient travel, the piston must begin to open the poppet valve well before top dead center of the piston. In the present invention, the piston 13 must apply only sufficient force to the valve stem 18B to break its seal. The closer the piston is to top dead center when it contacts the poppet valve stem 18B, the less power is required to operate the valve.

Figure 7C:
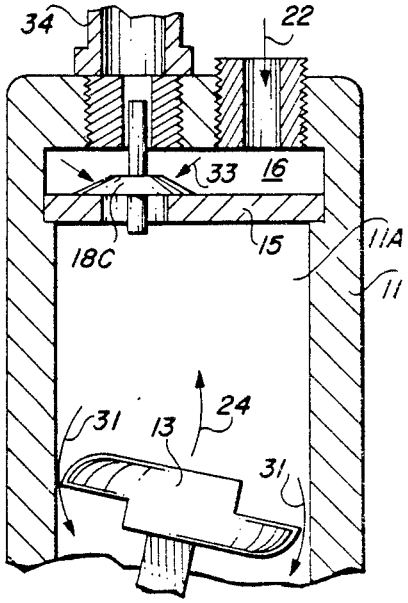

Referring to FIG. 7B, piston 13 undergoes rapid acceleration downward, as indicated by arrows 28. Pressurized gas designated by numeral 22 maintains the pressure in chamber 16. The sudden increase in volume of upper cylinder 11A results in a pressure drop which causes flow through the valve plate port 17. High velocity gas flowing past poppet valve 18 causes a drag force 29 to act on the valve. At the same time the high velocity gas flowing through port 17 causes a region of low pressure at the bottom of the valve. The resulting imbalance of forces cause the valve to close as seen in FIG. 7C. The gas contained in upper cylinder 11A continues to expand against piston 13 producing useful work.

Referring to FIG. 7B, during the downward movement of piston 13, its spherical surface 13A forms a tight seal with the inner wall of cylinder 11. By the time piston 13 has passed bottom dead center and is returning upward as indicated by arrow 24 in FIG. 7C, the notches 10 and 12 of the relieved piston 13 structure cause the seal to be broken and thereby allow gas in the upper portion 11A of cylinder 11 to flow downward past the walls of upward-moving piston 13, as indicated by arrows 31 in FIG. 7C. The gas in the upper section 11A of cylinder 11 therefore is not compressed, and poppet valve 18 remains closed until its lower stem 18B engages the top of relieved piston 13. The above described cycle then is repeated.

As the rotation rate of the crankshaft 5 increases, the poppet valve 18 closes sooner in each rotary cycle because of increased drag force on its skirt 18C from higher velocity gas passing through the valve port 17. This greater expansion of the gas let in the cylinder improves the efficiency of the motor at low torques and high speeds. When larger loads are applied slowing the rpm, the valve stays open longer allowing high pressure gas to act on the piston 13 for more of its stroke, producing more torque. This unique result makes possible a simple method of regulating the valving of an external pressure motor so as to provide a high starting torque and yet efficient high speed operation. This allows poppet valve 18 to close before bottom dead center of the piston stroke, allowing expansion of the gas against the to of piston 13. The poppet valve 18 is load-sensitive, uses less power, can stay open longer, and can travel farther to open the valve port than prior mechanically operated valves. As the motor rotation rate increases, the valve closes sooner because of increased drag forces resulting from higher velocity gas passing through the port. The valve allows full pressure over the piston for the full stroke, providing maximum starting torque. As the motor rotation rate increases, the valve closes before the piston reaches the bottom of the stroke, allowing some expansion of gas against the piston.

The inertial mass of the poppet valve influences the valve timing of the engine. A heavier poppet valve would tend to limit engine performance at high rpm. A poppet valve of lower inertial mass will have generally improved performance. It may be practical to adjust engine performance by providing an adjustable means for limiting travel of the poppet valve.

A very significant advantage of the above described embodiment of the invention is that the piston 13 meets very little resistance on its return to the top of cylinder 11, because the clearance of approximately 0.050 inches between the wall of cylinder 11 and the piston 13 when it is tilted so as to break the seal provides plenty of room for air to bypass the piston. The partially spherical configuration of the piston 13 allows points thereof on opposite sides of the tilt plane to act as pivot points or bearings in the cylinder, as well as forming the seal with the inner wall of the cylinder.

During laboratory tests of a prototype of the described motor which has a displacement of 0.75 cu. inches, a 1.0 inch diameter piston, and a 0.75 inch stroke, the prototype motor operated at 25,000 RPM when supplied with an inlet air pressure of 120 pounds per square inch of garage pressure (PSIG). The motor runs with an inlet pressure of as low as 2 PSIG.

The components of the motor can be composed of stainless steel, bronze, titanium, anodized aluminum, and engineering plastics.

It is expected that substantially larger embodiments of the fluid engine than those described herein will prove to be practical, especially where large, inexpensive sources of low pressure gas are available.

Figure 8B:
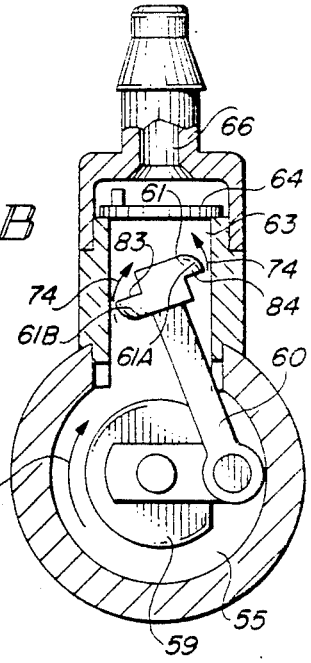
FIG. 8B is a section view of the view shown in FIG. 8A.
Figure 8A:
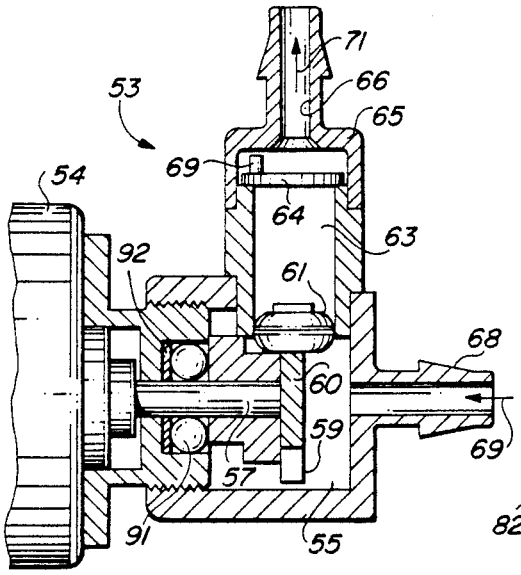
FIG. 8A is a partial section view of a pump in accordance with the present invention.
Figure 8C:
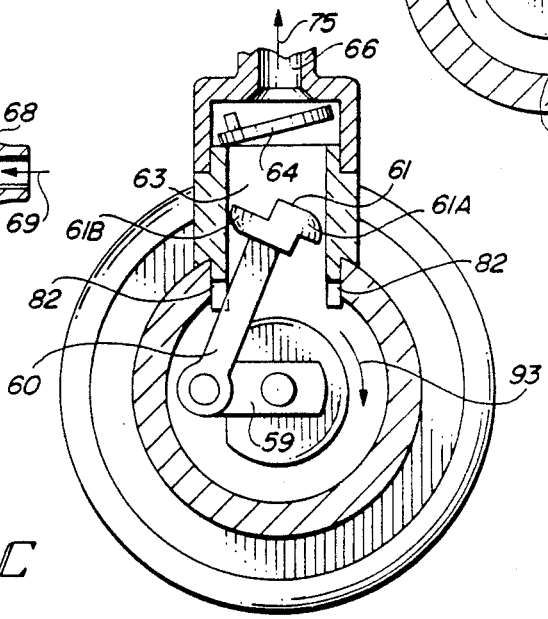
FIG. 8C is a section view useful in explaining the operation of the pump of FIG. 8A.

FIGS. 8A–8C are section views of an alternate embodiment of the invention in which a relieved piston 61 (similar to relieved piston 13 of FIG. 1) is utilized in a pump, rather than a fluid motor. A motor 54 drives a crankshaft 57 of fluid pump 53. A crankshaft arm 59 of crankshaft 5 has its outer end pivotally connected to a connecting rod 60, the other end of which is rigidly attached to relieved piston 61. A cylinder 63 is connected in fluid communication wi&:h a crankcase 55 that encloses crankshaft 57. A "floating" check valve 64 is positioned at the top of cylinder 63 between a cylinder head 65 attached to the top of cylinder 63. Check valve 64 has a post 69 at one end of its upper surface to prevent the top surface of floating valve 64 from sealing off the outlet passage 66 through head 65. O-ring 91 translates rotation from crankshaft 59 to mechanical seal disk 92 to effectuate a good fluid seal.

The operation of the fluid pump 53 can be understood with reference to FIGS. 8B and 8C. In FIG. 8B, with the crankshaft rotating clockwise in the direction of arrow 73, relieved piston 61 is being pulled downward. During that time, piston 61 is tilted to the left so that the notches 83 and 84 thereof produce a break in the seal between spherical outer surface of piston 61 and the wall of cylinder 63. This allows cylinder 63 to be filled with fluid from the crankcase 55 as fluid bypasses the edges of relieved piston 61 (as indicated by arrows 74). Meanwhile, check valve 64 seals off the top of cylinder 63, preventing any fluid from flowing into the upper end of cylinder 63 through outlet passage 66.

As crankshaft 57 rotates clockwise beyond the bottom dead center position of piston 61, and further rotates so that piston 61 tilts to the right as it travels upward as shown in FIG. 8C, the partial spherical surface of the upper section 61A and the lower section 61B of piston 61 forms a tight seal with the walls of cylinder 63, compressing the fluid in the upper portion of cylinder 63. The compressed fluid opens the check valve 64 and is forced out of outlet port 66, as indicated by arrow 75. The fluid pumped can be either gas or liquid. For efficient operation pumping a gas, a filler should be added to the piston to expel as much gas as possible from the cylinder at top dead center. If the direction of check valve is reversed, and the position of notches 83 and 84 are altered to form a passage on the upstroke of piston 61, the direction of fluid pumped will be reversed.

The components of the pump 53 shown in FIGS. 8A–8C can be composed of stainless steel and engineering plastic materials. A prototype was constructed in which the cylinder is 3.43 millimeters in diameter, and the stroke is 5.13 millimeters and the displacement is 0.048 cubic centimeters. The prototype pump with motor weighs only 27.4 grams. The clearance in FIG. 8B between the spherical outer surface of piston 61 and the cylindrical wall of cylinder 63 of the constructed prototype is approximately 0.0002 inches. When driven at 3,000 revolutions per minute, it can pump water into inlet 68 and out of outlet 66 at a pressure of approximately 18 pounds per square inch and at the rate of 2 cubic centimeters per second using only 4 watts of power supplied to electric motor 54. If a gear reduction is used between the motor and the pump power consumption can be reduced to approximately 2 watts. (Provision of a gear reduction unit between the motor and the pump lowers the rpm of the pump relative to the motor and increases the torque of the output shaft on which the pump crankshaft is mounted, and greatly improves overall efficiency.) This performance is made possible by the large flow of fluid through the passage around the tilted spherical piston 61, which allows large quantities of fluid through the pump 53 with low head loss. Since the piston acts as one of the two valves always required for pump operation, the exit check valve 64 may occupy the entire head area.

The unique "reliefs" or notches 83 and 84 on the spherical piston 61 allow the maximum possible clearance between the piston and the cylinder when the piston 13 is tilted to the left, while permitting the crankshaft to remain centered on an axis of the cylinder, and thereby providing maximum travel of the connecting rod 60 between cylinder walls. Provision of slots 82 on the bottom of cylinder 63, a radius on the bottom of cylinder 63 to clear the crankshaft, and an offset crank journal which allows 10 the rod journal to enter the cylinder slots 82, allows piston 61 to tilt 28.5 degrees and thereby provide a clearance of 12% of the cylinder area between the piston surface on the wall of cylinder 63 during the portion of the cycle illustrated in FIG. 8B.

Figure 9:
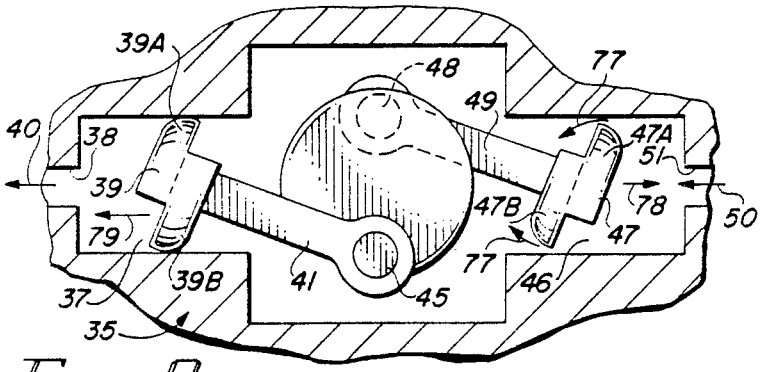
FIG. 9 is a schematic section view of a pump with two opposed asymmetric spherical pistons connected to a common crank.

Referring next to FIG. 9, another embodiment of the invention is shown containing two horizontally opposed relieved pistons of the type indicated in FIG. 3. Relieved pistons 39 and 47 are disposed in horizontally opposed cylinders 37 and 46, respectively. Relieved piston 39 is connected rigidly to one end of a connecting rod 41, the other end of which is connected by a bearing 45 to a crankshaft 48. Similarly, relieved piston 47 is connected by connecting rod 49 to the opposite side of crankshaft 48. Crankshaft 48 is housed in a sealed crankcase 35 that opens into cylinders 37 and 46.

The "upper" portion 47A of piston 47 is offset relative to the "lower" portion 47B in the manner shown in FIG. 9 so that as the crankshaft 48 rotates clockwise, the notches in piston 47 allow inlet fluid 50 to be drawn past piston 47 in the direction of arrows 77 and into crankcase 35 as piston 47 moves in the opposite direction. At the same time, piston 39 is tilted to form a seal to the wall of cylinder 37 as piston 39 moves to the left in the direction of arrow 79 and forces fluid out of outlet 38, as indicated by arrow 40. When crankshaft 48 has rotated 180 degrees from the position shown in FIG. 9, piston 39 moves to the right and is tilted in the opposite direction to that shown. Therefore, the seal of piston 39 to the wall of cylinder 37 is broken, and piston 47 also is tilted in the opposite direction to that shown, so that its partial spherical surface now forms a seal with the wall of cylinder 46. Piston 47 then is moving to the left and therefore forces fluid 50 to the left. Fluid in crankcase 35 then moves to the left, by passing the broken seal of piston 39, cylinder 37, and out of outlet 38 as indicated by arrow 40 while piston 3 is moving to the right.

Thus, during every half cycle or 180 degrees of rotation of crankshaft 48, one of pistons 39 and 47 acts as a sealed piston, thereby forcing the flow in the direction of that piston. At the same time, the opposing piston is unsealed and is being caused to travel against the flow of the fluid. This takes place for half of a cycle. During the next half of a cycle, the opposing pistons reverse functions. Thus, in this structure, one of the two pistons is always closed to the flow of fluid, so there is no need for a check valve.

It should be noted that the direction of flow of fluid shown by arrows 40 and 50 in FIG. 9 can be reversed by simply reversing the direction of rotation of crankshaft 48 from clockwise to counter clockwise.

While the invention has been described with reference to several particular embodiments thereof, those skilled in the art will be able to make various modifications to the described embodiments without departing from the true spirit and scope of the invention. For example, flow reversal can be achieved by reversing the reliefs on the pistons 39 and 47 of the pump shown in FIG. 9. This can also be accomplished by reversing the shaft rotation. Flow direction in the pump shown in FIG. 8A can be similarly reversed if the direction of the check valve is reversed. In large displacement motors, multiple valves may be used to facilitate construction. When working with high pressures in larger motors, a small diameter pilot valve triggered by the piston may be used to equalize the pressure between chamber 16 and cylinder 11A which opens the main valve. The motor shown in FIG. 2 will operate with a vacuum applied to outlet 21.

What is claimed is:

1. A pump comprising in combination:

(a) a cylinder, and a cylinder head having an outlet;

(b) a check valve means for allowing flow of fluid from the cylinder to the outlet and to prevent flow of fluid from the outlet into the cylinder;

(c) a piston moveable in the cylinder having a connecting rod with a first end rigidly connected to the piston;

(d) a crankshaft pivotally connected a lower end of the connecting rod, the piston having a surface that forms a seal with an inner wall of the cylinder during an upstroke as the piston is tilted in a first direction and producing a passage between upper and lower portions of the piston when the piston is tilted in a second direction opposite to the first direction, wherein the piston includes a partially spherical surface that acts as a pivot for the piston as it tilts in the cylinder from the first direction to the second direction, and wherein the piston includes an upper surface having a first relief notch adjacent to a first side of the piston and a lower surface with a second relief notch adjacent to a second side of the piston opposite to the first side, the first and second relief notches allowing fluid to pass between the piston and a wall of the cylinder when the piston is tilted in the second direction.

2. The pump of claim 1 wherein the piston is tilted in the first direction during an upstroke and is tilted in the second direction during a downstroke.

3. The pump of claim 1 wherein the passage is between a surface of the piston and a wall of the cylinder.

4. The pump of claim 1 wherein the first relief notch subtends approximately one third of the area of the upper surface and the second relief notch subtends approximately one third of the area of the lower surface.

5. The pump of claim 4 wherein the cylinder includes opposed first and second slots in a bottom wall of the cylinder for accommodating the connecting rod to allow maximum tilting of the piston in the first and second directions, respectively, without contact between the piston rod and the cylinder.

6. The pump of claim 2 wherein the check valve is disposed between the cylinder and the cylinder head, and allows flow of fluid out of an outlet in the cylinder head, the pump having a crankcase around the crankshaft and having an inlet in the crankcase through which the fluid flows.

7. A pump comprising in combination:

(a) a first cylinder with a first cylinder head having an outlet, and a second cylinder with a second cylinder head having an inlet;

(b) a first piston moveable in the first cylinder having a first connecting rod with a first end rigidly connected to the first piston;

(c) a second piston moveable in the second cylinder having a second connecting rod with a first end rigidly connected to the second piston;

(d) a crankshaft having a first point pivotally connected to a second end of the first connecting rod and a second point opposite to the first point pivotally connected to a second end of the second crankshaft, and a crankcase enclosing the crankshaft and connected in sealed relationship to inner ends of the first and second cylinders, the first piston having a surface that forms a seal with an inner wall of the first cylinder during an outstroke of the first piston away from the crankshaft and producing a first fluid passage between inner and outer surfaces of the first piston during an instroke of the first piston toward the crankshaft to allow fluid to pass from the crankcase to an outer portion of the first cylinder and out of the outlet, the second piston having a surface that forms a seal with an inner wall of the second cylinder during an instroke of the second piston toward the crankshaft and producing a second fluid passage between inner and outer surfaces of the second piston during an outstroke of the second piston away from the crankshaft to allow fluid to pass from the inlet to the crankcase, an outstroke of the first piston occurring during an instroke of the second piston, each of the first and second pistons acting to force fluid from the inlet toward the outlet while the other of the first and second pistons allows the forced fluid to move past the other of the first and second pistons toward the outlet.

8. A method of operating a pump comprising the steps of:

(a) simultaneously drawing fluid behind a piston in a cylinder into a crankcase through an inlet and forcing fluid ahead of the piston out of an outlet in a head of the cylinder connected to the crankcase during an outstroke of the piston away from the crankcase by tilting the piston to form a continuous seal between the piston and an inner wall of the cylinder during the outstroke;

(b) simultaneously preventing reverse flow of fluid in the direction from the outlet toward the inlet by operation of a check valve means and allowing the fluid to pass from an inner side of the piston to an outer side of the piston during an instroke of the piston toward the crankcase by tilting the piston to produce a passage from the inner side to the outer side during the instroke;

the piston having a partially spherical, partially asymmetrical surface that forms the continuous seal when the piston is tilted in a first direction and forms a passage that allows the fluid to pass from the inner side to the outer side of the piston when the piston is tilted in a second direction opposite to the first direction;

(c) providing a first relief notch in an upper surface of the piston adjacent to a first side of the piston and a second relief notch in a lower surface of the piston adjacent to a second side of the piston opposite to the first side, and allowing fluid to pass between the piston and a wall of the cylinder when the piston is stilted in step (b) to produce the passage, to thereby provide maximum clearance between the piston and the cylinder.

9. A fluid machine comprising in combination:

(a) a cylinder, and a cylinder head having an outlet;

(b) valve means for allowing flow of fluid in a first direction between the cylinder and the outlet and to prevent flow of fluid in a second direction opposite to the first between the outlet and the cylinder;

(c) a piston moveable in the cylinder having a connecting rod with a first end rigidly connected to the piston;

(d) a crankshaft pivotally connected to a lower end of the connecting rod, the piston having a surface that forms a seal with an inner wall of the cylinder during a stroke in a third direction as the piston is tilted in a fourth direction and producing a passage between upper and lower portions of the piston when the piston is tilt in a fifth direction opposite to the fourth direction, wherein the piston includes a partial spherical surface that acts as a pivot for the piston as it tilts in the cylinder from the fourth direction to the fifth direction, and wherein the piston includes an upper surface having a first relief notch adjacent to a first side of the piston and a lower surface with a second relief notch adjacent to a second side of the piston opposite to the first side, the first and second relief notches allowing fluid to pass between the piston and a wall of the cylinder when the piston is tilted in the fifth direction.

10. The fluid machine of claim 9 wherein the fluid machine is a fluid engine, and wherein the valve means includes i. a valve plate disposed in the cylinder beneath the cylinder head and bounding a first volume between the valve plate and the cylinder head and a second volume in the cylinder, ii. a poppet valve disposed in the first volume operating to open and close an opening in the valve plate, the poppet valve having a lower stem extending through the valve plate into the second volume, and an upper stem extending through a valve guide and exposed to low pressure, the poppet valve having a skirt disposed in a region of thigh velocity fluid flow while the poppet valve is open.

11. The fluid machine of claim 9 wherein the first relief notch subtends approximately one-third of the area of the upper surface and the second relief notch subtends approximately one-third of the area of the lower surface, the first and second relief notches being offset to terminate the partially spherical surface of the piston, forming the seal when the piston is tilted in one direction and breaking the seal when the piston is tilted in an opposite direction.

12. A pump comprising in combination:

(a) a first cylinder with a first cylinder head having an outlet, and a second cylinder with a second cylinder head having an inlet;

(b) a first piston moveable in the first cylinder having a first connecting rod with a first end rigidly connected to the first piston;

(c a second piston moveable in the second cylinder having a second connecting rod with a first end rigidly connected to the second piston;

(d) a crankshaft having a first point pivotally connected to a second end of the first connecting rod and a second point opposite to the first point pivotally connected to a second end of the second crankshaft, and a crankcase enclosing the crankshaft and connected in sealed relationship to inner ends of the first and second cylinders, the first piston having a surface that forms a seal with an inner wall of the first cylinder during an outstroke of the first piston away from the crankshaft and producing a first fluid passage between inner and outer surfaces of the first piston during an instroke of the first piston toward the crankshaft to allow fluid to pass from the crankcase to an outer portion of the first cylinder and out of the outlet, the second piston having a surface that forms a seal with an inner wall of the second cylinder during an instroke of the second piston toward the crankshaft and producing a second fluid passage between inner and outer surfaces of the second piston during an outstroke of the second piston away from the crankshaft to allow fluid to pass from the inlet to the crankcase, an outstroke of the first piston occurring during an instroke of the second piston, each of the first and second pistons acting to force fluid from the inlet toward the outlet while the other of the first and second pistons allows the forced fluid to move past the other of the first and second pistons toward the outlet;

wherein the first and second pistons each include a partially spherical surface that acts as a pivot for that piston as it tilts in the first cylinder or the second cylinder, respectively, and wherein each of the first and second pistons includes an upper surface having a first relief notch adjacent to a first side of that piston and a lower surface with a second relief notch adjacent to a second side of that piston opposite to the first side, the first and second relief notches allowing fluid to pass between the piston and a wall of the cylinder when that piston is tilted in one of two opposite directions.

* * * * *